United States Patent [19]

Yashima

[11] Patent Number: 4,505,618

[45] Date of Patent: Mar. 19, 1985

[54] MARINE RISER PROTECTOR FOR USE ON OFFSHORE OIL DRILLING RIGS IN ICY WATERS

[75] Inventor: Nobuyoshi Yashima, Funabashi, Japan

[73] Assignee: Mitsui Engineering & Shipbuilding Co., Ltd., Tokyo, Japan

[21] Appl. No.: 490,147

[22] Filed: Apr. 29, 1983

[30] Foreign Application Priority Data

Oct. 22, 1982 [JP] Japan ..... 57-158987[U]
Mar. 10, 1983 [JP] Japan ..... 58-33423[U]

[51] Int. Cl.[3] ..... E02B 15/02

[52] U.S. Cl. ..... 405/211; 405/61; 405/195

[58] Field of Search ..... 405/211–213, 405/216, 217, 61; 166/350, 359, 368

[56] References Cited

U.S. PATENT DOCUMENTS 934,176 9/1909 Hubbard ..... 405/216
3,142,343 7/1964 Otteman et al. ..... 166/368 X
3,369,599 2/1968 Evans ..... 166/350
3,370,432 2/1968 Butler et al. ..... 405/216
4,063,428 12/1977 Waas ..... 405/212
4,388,025 6/1983 Evans ..... 405/212

FOREIGN PATENT DOCUMENTS 56-150211 11/1981 Japan ..... 405/211

*Primary Examiner*—Dennis L. Taylor
*Attorney, Agent, or Firm*—Armstrong, Nikaido, Marmelstein & Kubovcik

[57] ABSTRACT

An apparatus for protecting a marine riser extending downwardly from a platform of an offshore station above a sea level toward a sea bottom. A tubular protector is removably mounted on the underside of the platform in surrounding relation to the marine riser in the vicinity of the sea level. According to another embodiment, a tubular protector has an upper portion in the shape of a truncated cone for contact with ice floes and a lower portion shaped as a grid-like truncated cone flaring downwardly for diverting ice floes away from the tubular protector.

2 Claims, 8 Drawing Figures

MARINE RISER PROTECTOR FOR USE ON OFFSHORE OIL DRILLING RIGS IN ICY WATERS

BACKGROUND

The present invention relates to an apparatus for protecting marine risers extending underwater from offshore oil drilling rigs in icy waters against damage due to the pressure of ice floes.

Offshore platforms such as oil drilling rigs on the open sea have marine risers extending underwater from the platform toward the sea bottom. The conventional drilling platforms have been equipped with no apparatus for protecting the marine risers from ice floes.

The marine risers therefore have suffered from the problem of being broken or otherwise damaged by ice floes which hit or are pressed against the marine risers. One known way to solve this problem has been to use specially designed marine risers rugged enough to withstand the hitting or pressing engagement with ice floes during the season in which floating ice is expected to come around the offshore platforms. The offshore structure used in icy waters are therefore costly to construct.

SUMMARY

It is an object of the present invention to provide an apparatus for protecting marine risers against damage due to hitting or pressing engagement with ice floes.

According to the present invention, a conical or cylindrical tubular protector is disposed in surrounding relation to a marine riser in the vicinity of a sea level, the marine riser extending from a platform of an offshore station above the sea level down to a sea bottom.

According to another embodiment, a marine riser protector has a portion in the shape of a truncated cone for contact with ice floes and a lower portion shaped as a grid-like truncated cone flaring downwardly.

The above and other objects, features and advantages of the present invention will become more apparent from the following description when taken in conjunction with the accompanying drawings in which preferred embodiments of the present invention are shown by way of illustrative example.

DRAWINGS

PREFERRED EMBODIMENTS

Figure 1:
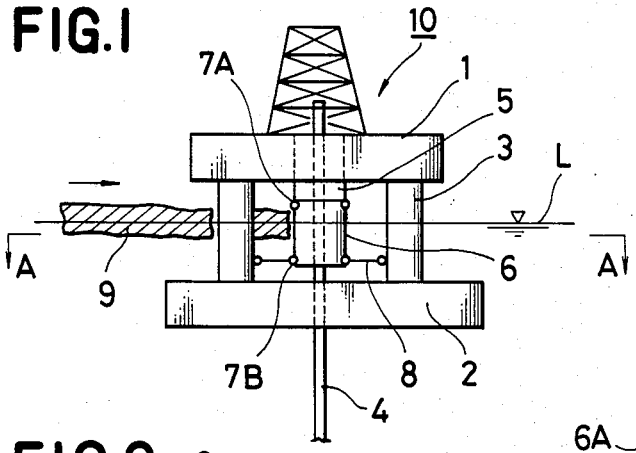
FIG. 1 is a schematic side elevational view of an offshore structure having a marine riser protector for use in icy waters according to a first embodiment of the present invention.
Figure 2:
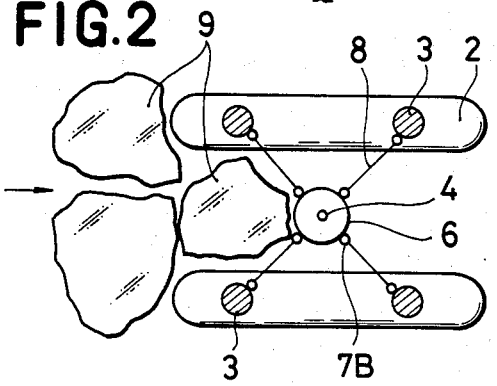
FIG. 2 is a cross-sectional view taken along line A—A of FIG. 1.

As shown in FIG. 1, an offshore structure 10 according to a first embodiment of the present invention is a semisubmersible oil drilling rig comprising a platform 1 supported by four posts or legs 3 (FIG. 2) on a pontoon 2 submerged in sea water. A marine riser 4 extends from the platform 1 downwardly to the sea bottom and is connected to an associated device on the sea bottom.

Figure 3:
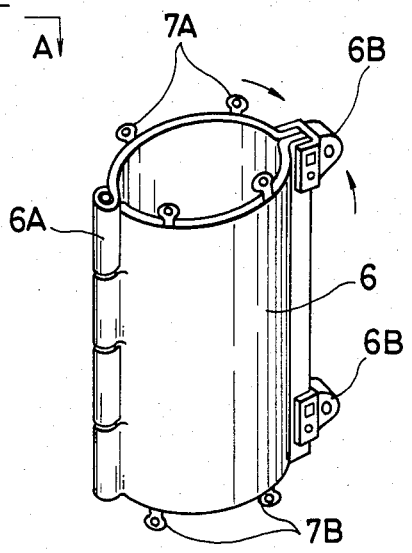
FIG. 3 is a perspective view of a marine riser protector in the apparatus shown in FIG. 1.

According to the present invention, a tubular protector 6 of a cylindrical shape as shown in FIG. 3 is disposed below a tube attachment guide 5 mounted on the underside of the platform 1 and attaching the marine riser 4. The tubular protector 6 extends around the marine riser 4 in the vicinity of a sea level L and is removably attached by four joints 7A on an upper edge of the tubular protector 6 to the tube attachment guide 5.

The tubular protector 6 is composed of a pair of vertical semicylindrical members angularly movably interconnected by a hinge 6A and having mating flanges disposed in diametrically opposite relation to the hinge 6A and separably coupled with each other by connectors 6B, 6B. For attaching the tubular protector 6, the vertical semicylindrical members are spread away from each other and brought around the marine riser 4, and then coupled together by the connectors 6B, 6B. The upper edge of the tubular protector 6 is connected by joints 7A to the tube attachment guide 5. Thereafter, joints 7B on a lower edge of the tubular protector 6 are fastened by fastener members 8 such as wires or chains to the posts 3 or the pontoon 2.

Figure 4:
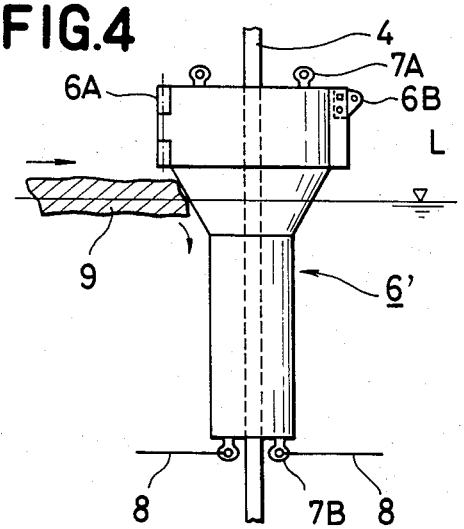
FIG. 4 is a side elevational view of a marine riser protector according to a second embodiment of the present invention.
Figure 5:
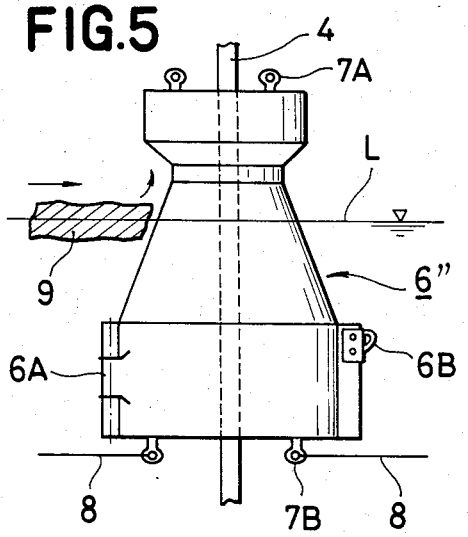
FIG. 5 is a side elevational view of a marine riser protector according to a third embodiment of the present invention.

The tubular protector 6 may be of other shapes than the cylindrical configuration. For example, a tubular protector 6' according to a second embodiment shown in FIG. 4 has a portion in the shape of a truncated cone tapered downwardly in the vicinity of the sea level L. Alternatively, as shown in FIG. 5, a tubular protector 6'' according to a third embodiment has a portion shaped as a truncated cone tapered upwardly in the vicinity of the sea level L. These conically tapered tubular protectors 6', 6'' can provide an increased ability to break ice floes 9 floating on the sea level L.

The tubular protectors 6, 6', 6'' are disposed in surrounding relation to the marine riser 4 for protecting the latter against ice floes 9, and are required to have a mechanical strength large enough to withstand the attack of flating ice floes 9. To reduce wave forces during the seasons in which no ice floe is around the offshore structure, the tubular protectors 6, 6', 6'' can easily be removed or lifted off the water in such seasons.

Where the marine riser protector of the invention is incorporated in an offshore structure placed in icy waters, the marine risers can be protected against damaging ice floes to thereby allow continued activities on the platforms throughout the season in which there are ice floes around the offshore structure. The marine riser protector can be removed or lifted off the sea level so that the offshore structure will be subjected to reduced wave forces while the waves are high when the offshore structure is in use on the open sea or during the ice-floe season.

The tubular protector 6 removably mounted for protecting the marine riser 4 extending from the platform 1 to the sea floor is best suited for protection against ice floes having relatively small thicknesses. As the ice floes become thicker, the tubular protector 6 needs to be larger in size and more durable in construction.

The larger the tubular protector 6, the greater the wave forces it undergoes.

According to a fourth embodiment, the above difficulty is eliminated by a marine riser protecting apparatus constructed of a marine riser protector projecting into water from the underside of a platform in surrounding relation to a marine riser and including a portion in the shape of a truncated cone for contact with ice floes and a lower portion shaped as a grid-like truncated cone flaring downwardly.

Figure 6:
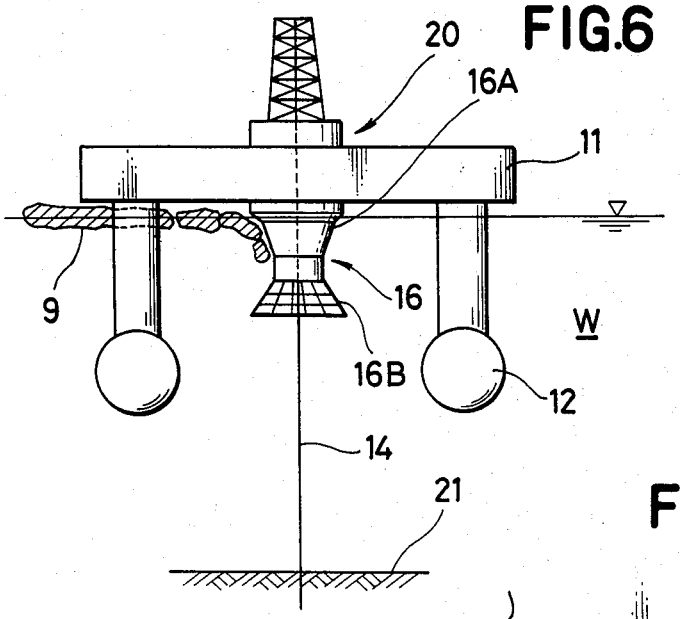
FIG. 6 is a schematic side elevational view of an offshore structure having a marine riser protector according to a fourth embodiment of the present invention.
Figure 7:
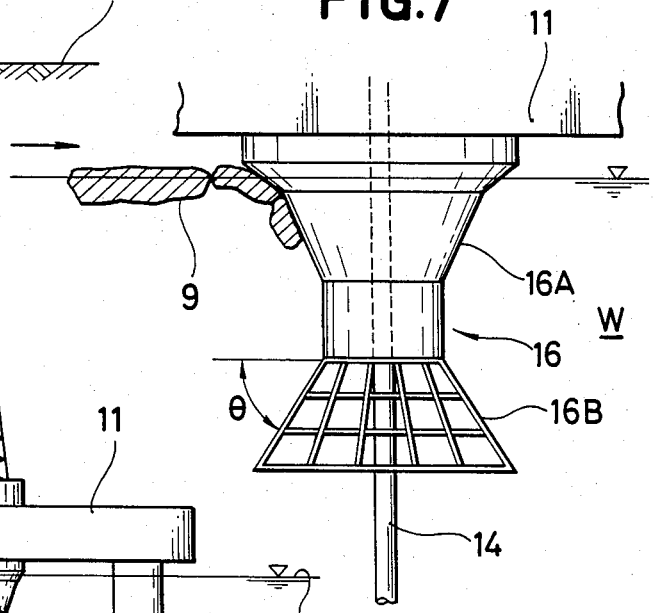
FIG. 7 is a side elevational view of a marine riser protector in the apparatus shown in FIG. 6.
Figure 8:
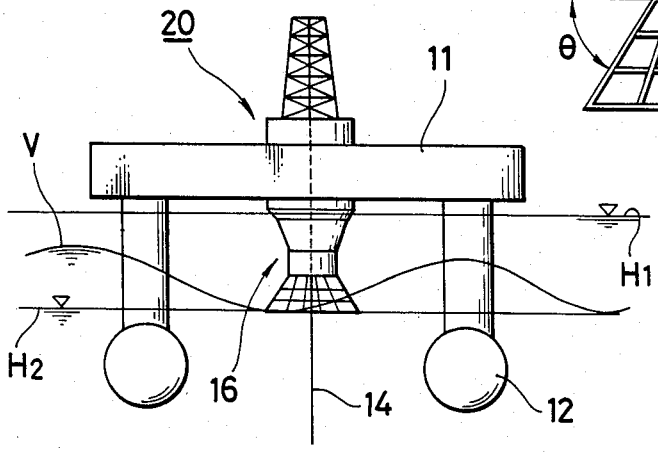
FIG. 8 is a side elevational view illustrative of the relationship between the marine riser protector of FIG. 6 and open sea levels.

FIGS. 6 through 8 show a marine riser protector according to a fourth embodiment of the present invention. The marine riser protector shown in FIGS. 6 through 8 is designed to reduce the wave forces that hit the marine riser protector. An offshore structure 20 illustrated in FIG. 6 is a semisubmersible oil drilling rig comprising a platform 11 supported by posts or legs 13 on a pontoon 12, and a marine riser 14 extending downwardly from the platform 11 to a sea floor 21. A marine riser protector 16 is mounted on the underside of the platform 11 and projected downwardly into sea water W in surrounding relationship to the marine riser 14.

As best seen from FIG. 7, the marine riser protector 16 includes an upper portion 16A for contact with ice floes 9, which is in the shape of a truncated double cone having a diameter progressively smaller in the downward direction. The marine riser protector 16 also has a lower portion 16B shaped as a grid-like truncated cone flaring downwardly. Ice floes 9 brought into contact with the upper portion 16A are guided by the upper portion 16A to go downwardly into engagement with the lower portion 16B, which then deflects the ice floes 9 outwardly away from the marine riser protector 16. Thus, the lower portion 16B serves to bend and divert the ice floes 9 away from the marine riser protector 16. With this arrangement, almost no ice floe is allowed to enter the marine riser protector 16.

It is preferable that the angle $\theta$ formed between the horizontal plane and the peripheral surface of the conically tapered lower portion 16B be in the range of $30° \leqq \theta \leqq 65°$.

As is conventionally practiced, the offshore structures 10 and 20 may be anchored at the prescribed offshore location.

The offshore structure 20 with an oil drilling rig thereon will be described with reference to various sea levels therefor as shown in FIG. 8. During the season or in the area in which there are ice floes on the sea, the offshore structure 20 is controlled so that the sea level is held at H1. When there is no ice floes around, or in the region in which no ice floe floats on the sea, the offshore structure 20 is kept at a sea level H2. At this time, the marine riser protector 16 is positioned above the sea level H2, with the result that the grid-like lower portion 16B is less subjected to the influence of waves when the latter have a height as shown at V in FIG. 8.

With the marine riser protector of the present invention, no ice floe is forced into direct hitting contact with the marine riser 14, and hence any conventional simple marine risers can be used on offshore structure. The grid-like lower portion 16B can divert ice floes 9 away from the protector 16 so that substantially no ice floes will find their way into the protector 16. The marine riser protector of the invention is also advantageous in that it can reduce adverse effects thereon due to waves hitting the protector.

Although certain preferred embodiments have been shown and described, it should be understood that many changes and modifications may be made therein without departing from the scope of the appended claims.

What is claimed is:

1. In a semi-submersible offshore structure comprising normally submerged pontoon means, standing posts disposed on the pontoon means, a platform mounted on the standing posts and supported above sea level by the standing posts and a marine riser extending from the platform toward the sea bottom, a riser protector secured to the underside of the platform and extending downward therefrom, the riser protector comprising a truncated conical upper portion having a diameter which is gradually reduced in the downward direction and a truncated conical lower portion having a diameter which is gradually increased in the downward direction, the lower portion being connected to the bottom of the upper portion and having a grid-like wall structure, wherein the level of the structure with respect to sea level is controlled such that in an ice-forming or ice-floating season or area, the sea level corresponds to the upper portion of the riser protector and in an iceless or ice-free season or area, the sea level corresponds to the lower portion.

2. A riser protector as claimed in claim 1, wherein the peripheral surface of the lower portion of the riser protector has an angle of inclination of 30° to 60° relative to the horizontal plane.

* * * * *